US011847968B1

(12) United States Patent
Peng et al.

(10) Patent No.: US 11,847,968 B1
(45) Date of Patent: Dec. 19, 2023

(54) DISPLAY PANEL AND DISPLAY DEVICE

(71) Applicant: WUHAN CHINA STAR OPTOELECTRONICS SEMICONDUCTOR DISPLAY TECHNOLOGY CO., LTD., Hubei (CN)

(72) Inventors: Wenlong Peng, Hubei (CN); Tao Chen, Hubei (CN)

(73) Assignee: WUHAN CHINA STAR OPTOELECTRONICS SEMICONDUCTOR DISPLAY TECHNOLOGY CO., LTD., Hubei (CN)

( * ) Notice: Subject to any disclaimer, the term of this patent is extended or adjusted under 35 U.S.C. 154(b) by 0 days.

(21) Appl. No.: 17/793,403

(22) PCT Filed: Jul. 12, 2022

(86) PCT No.: PCT/CN2022/105241

§ 371 (c)(1),
(2) Date: Jul. 17, 2022

(51) Int. Cl.
*G09G 3/3233* (2016.01)
*G09G 3/3275* (2016.01)

(52) U.S. Cl.
CPC ..... *G09G 3/3233* (2013.01); *G09G 3/3275* (2013.01); *G09G 2320/0247* (2013.01); *G09G 2330/021* (2013.01)

(58) Field of Classification Search
CPC ..... B25J 13/082; B25J 13/084; B25J 15/00; B25J 19/02; G01L 1/148; G01L 5/00; G01L 5/0061; G01L 5/165; G01L 5/228; G06F 3/016; G06F 3/0447; G06F 3/04886; G06F 2203/04809; G09G 3/3607; G09G 2320/0233; G09G 2320/0247; G09G 2320/0276; G09G 2320/0673; G09G 3/20; G09G 3/3275; G09G 3/3688; G09G 2300/0426; G09G 2310/027;
(Continued)

(56) References Cited

U.S. PATENT DOCUMENTS

2004/0217935 A1 11/2004 Jeon et al.
2021/0407419 A1* 12/2021 Li ..... G09G 3/3258
2023/0066643 A1* 3/2023 Zhang ..... G09G 3/3688

FOREIGN PATENT DOCUMENTS

CN 103680443 A 3/2014
CN 103794181 A 5/2014
(Continued)

OTHER PUBLICATIONS

International Search Report in International application No. PCT/CN2022/105241,dated Dec. 19, 2022.
(Continued)

*Primary Examiner* — Nelson M Rosario
(74) *Attorney, Agent, or Firm* — Mark M. Friedman

(57) ABSTRACT

A display panel and a display device are provided. By making a number of first gate strobe circuits of a same stage, a number of second gate strobe circuits of a same stage, and a number of third gate strobe circuits of a same stage electrically connected to a plurality of pixel driving circuits located in a same pixel row to be at most two, which is conducive to realizing a narrow bezel design when the dynamic refresh rates are adopted in the display panel.

20 Claims, 9 Drawing Sheets

(58) Field of Classification Search
CPC ..... G09G 2310/0297; G09G 2310/08; B60K 37/02; H10K 59/1213; H10K 59/131
See application file for complete search history.

(56) References Cited

FOREIGN PATENT DOCUMENTS

| | | | |
|---|---|---|---|
| CN | 108399895 | A | 8/2018 |
| CN | 111383553 | A | 7/2020 |

OTHER PUBLICATIONS

Written Opinion of the International Search Authority in International application No. PCT/CN2022/105241, dated Dec. 19, 2022.

* cited by examiner

DISPLAY PANEL AND DISPLAY DEVICE

BACKGROUND OF INVENTION

Field of Invention

The present application relates to the field of display technology and particularly to a display panel and a display device.

Description of Prior Art

Adopting dynamic refresh rates for realizing display control of display panels can reduce power consumption of the display panels. However, flickering problem occurs when the display panels that low refresh rates are adopted display. In this way, corresponding control signals are generally added to improve the low-rate flicker problem. However, increment of control signals can correspondingly increase a number of circuits of generating the control signals, resulting in increment of areas occupied by the control circuits in bezel areas, which is not conducive to realizing of narrow bezel design of the display panels.

SUMMARY OF INVENTION

Embodiments of the present application provide a display panel and a display device. By performing layout configuration on a plurality of strobe driving circuits, it is conducive to realizing the narrow bezel design in the display panel when the dynamic refresh rates are adopted.

One embodiment of the present application further provides a display panel. The display panel includes a plurality of strobe driving circuits and a plurality of pixel rows. The plurality of strobe driving circuits includes a plurality of cascaded first strobe driving circuits, a plurality of cascaded second strobe driving circuits, and a plurality of cascaded third strobe driving circuits. The plurality of cascaded first strobe driving circuits respond to a first start signal to output a plurality of first strobe signals. The plurality of cascaded second strobe driving circuits respond to a second start signal to output a plurality of second strobe signals. The plurality of cascaded third strobe driving circuits respond to a third start signal to output a plurality of third strobe signals. In a writing frame and a holding frame, valid pulses of the first start signal and valid pulses of the second start signal are in action time of invalid pulses of the third start signal. Each of the plurality of pixel rows includes a plurality of sub-pixels and a plurality of pixel driving circuits electrically connected to the plurality of sub-pixels. Each of the pixel driving circuits includes a first transistor, a second transistor, a third transistor, a fourth transistor, a fifth transistor, a sixth transistor, and a seventh transistor. The second transistor responds the corresponding first strobe signal to transmit a data signal so that the first transistor generates a driving current of controlling the sub-pixels to emit light according to the data signal. The third transistor responds to the corresponding second strobe signal to compensate a threshold value of the first transistor. The fourth transistor responds to the corresponding second strobe signal to transmit a first reset signal to a gate electrode of the first transistor. The fifth transistor and the sixth transistor simultaneously respond to the same corresponding third strobe signal so that the first transistor provides the driving current to the sub-pixels. The seventh transistor responds to the corresponding first strobe signal to transmit a second reset signal to an anode the sub-pixels. Wherein, stages of the first strobe signals responded by the second transistor and the seventh transistor are different, stages of the second strobe signals responded by the third transistor and the fourth transistor are different, each of the third strobe driving circuits is electrically connected to the plurality of the pixel driving circuits in adjacent two of the pixel rows; a number of the first gate strobe circuits of a same stage electrically connected to the plurality of the pixel driving circuits in a same pixel row is at most two, a number of the plurality of second gate strobe circuits of a same stage electrically connected to the plurality of the pixel driving circuits located in the same pixel row is at most two, a number of the plurality of third gate strobe circuits of a same stage electrically connected to the plurality of the pixel driving circuits located in the same pixel row is at most two.

The present application further includes a display device, including any aforesaid display panel and a time schedule controller. The time schedule controller is electrically connected to the plurality of strobe driving circuits.

Compared to the prior art, in the display panel and the display device provided by the embodiments of the present application, By performing layout configuration on the plurality of strobe driving circuits electrically connected to the plurality of pixel driving circuits of one same pixel row, the number of first gate strobe circuits of a same stage, the number of second gate strobe circuits of a same stage, and the number of third gate strobe circuits of a same stage electrically connected to a plurality of pixel driving circuits in a same pixel rows are at most two, which is conducive to realizing a narrow bezel design when the dynamic refresh rates are adopted in the display panel.

DETAILED DESCRIPTION OF EMBODIMENTS

For making the purposes, technical solutions and effects of the present application be clearer and more definite, the present disclosure will be further described in detail below. It should be understood that the specific embodiments described herein are merely for explaining the present application and are not intended to limit the present application.

Figure 1:
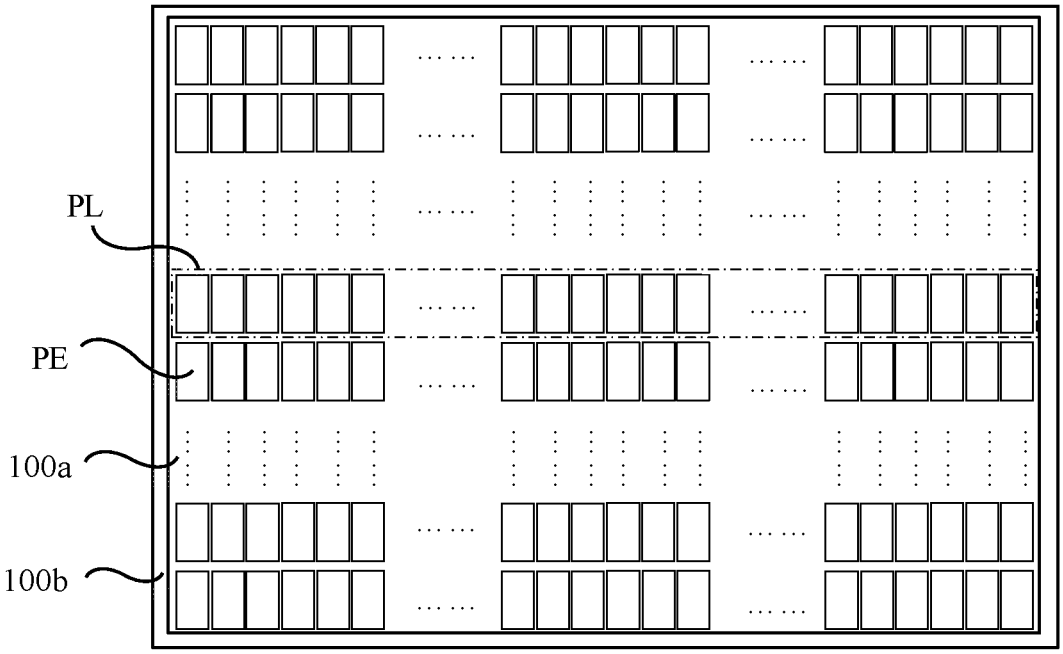
FIG. 1 is a structural schematic diagram of a display panel provided by one embodiment of the present application.

Specifically, illustrated in FIG. 1 is a structural schematic diagram of a display panel provided by one embodiment of the present application. One embodiment of the present application provides a display panel. Optionally, the display panel includes a self-luminous display panel, a quantum dot display panel, a touch display panel, etc. Optionally, the display panel includes a display region 100*a* and a non-display region 100*b*. Wherein the display region 100*a* is configured to realize a display function. Optionally, the non-display region 100*b* can be located on a periphery of the display region 100*a*. Optionally, in some embodiments, the display panel further includes a sensing region. The sensing region can be enclosed by the display region 100*a* and/or the non-display region 100*b*, and the sensing region is configured to realize functions of sensing, etc.

The display panel includes a plurality of pixel rows PL, a plurality of strobe lines, a plurality of data line, and a plurality of strobe driving circuits.

Optionally, the plurality of pixel rows are located in the display region 100*a*. Each of the pixel rows PL includes a plurality of sub-pixels PE and a plurality of pixel driving circuits electrically connected to the plurality of sub-pixels PE. Optionally, the sub-pixels PE include light-emitting devices. The light-emitting devices include organic light emitting diodes, sub-millimeter light emitting diodes, or micro light emitting diodes, etc.

Figure 2A:
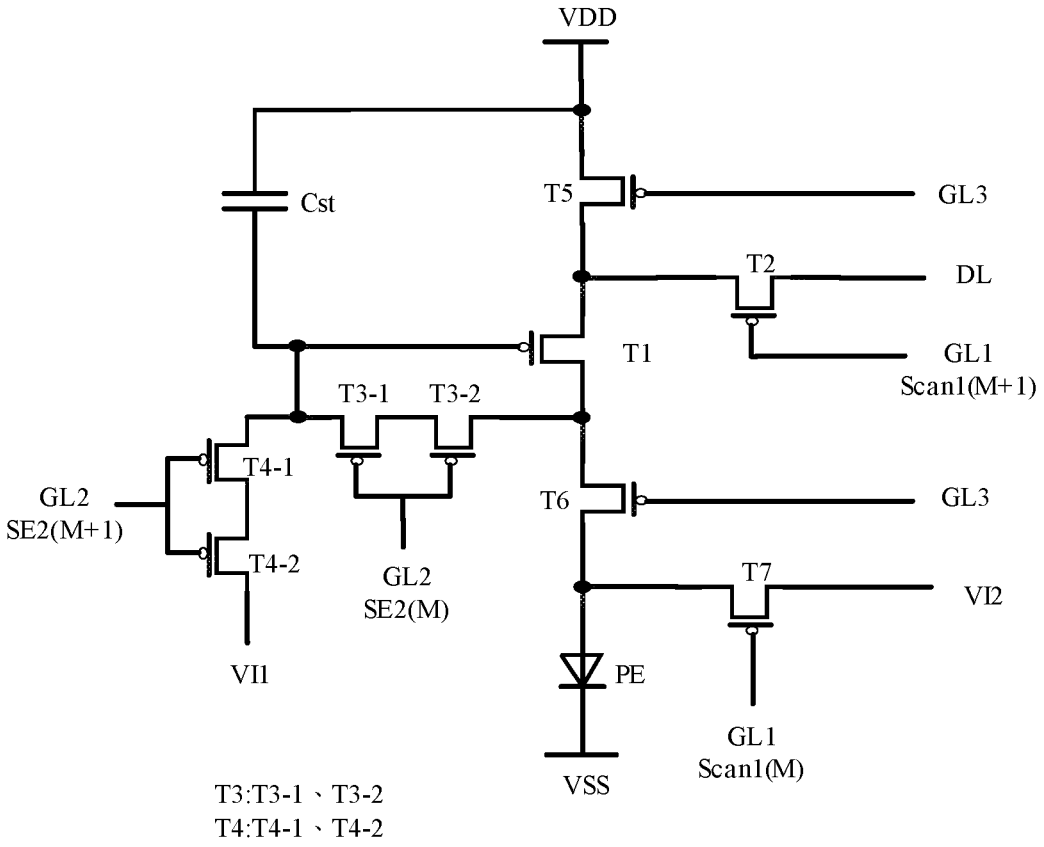
FIG. 2A to FIG. 2B are structural schematic diagrams of pixel driving circuits provided by one embodiment of the present application.
Figure 2B:
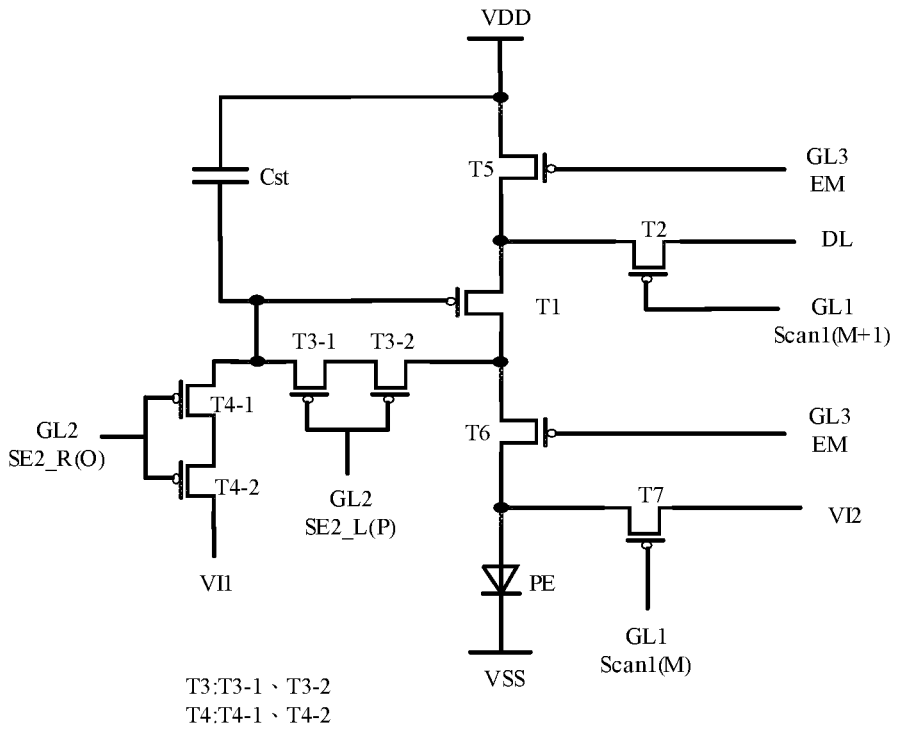

Illustrated in FIG. 2A to FIG. 2B are structural schematic diagrams of the pixel driving circuits provided by one embodiment of the present application. The pixel driving circuit includes a first transistor T1, a second transistor T2, a third transistor T3, a fourth transistor T4, a fifth transistor T5, a sixth transistor T6, a seventh transistor T7, and a capacitor Cst.

Optionally, the first transistor T1 and the corresponding sub-pixel PE are connected in series between a first voltage terminal VDD and a second voltage terminal VSS, a source electrode and a drain electrode of the second transistor T2 are electrically connected between the corresponding data line DL and one of a source electrode and a drain electrode of the first transistor T1 electrically connected to the first voltage terminal VDD, a source electrode and a drain electrode of the third transistor T3 are electrically connected between a gate electrode of the first transistor T1 and one of the source electrode and the drain electrode of the first transistor T1 electrically connected to the second voltage terminal VSS, a source electrode and a drain electrode the fourth transistor T4 are electrically connected between a first reset signal line VI1 and the gate electrode of the first transistor T1, a source electrode and a drain electrode of the fifth transistor T5 are electrically connected between the first voltage terminal VDD and one of the a source electrode and the drain electrode of the first transistor T1 electrically connected to the second transistor T2, a source electrode and a drain electrode of the sixth transistor T6 are electrically connected between the second voltage terminal VSS and one of the source electrode and the drain electrode of the first transistor T1 electrically connected to the third transistor T3, a source electrode and a drain electrode of the seventh transistor T7 are electrically connected between the corresponding sub-pixel PE and a second reset signal line VI2, and the storage capacitor Cst is connected in series between the gate electrode of the first transistor T1 and the first voltage terminal VDD. Optionally, both the third transistor T3 and the fourth transistor T4 are dual-gate transistors, i.e., the third transistor T3 includes a transistor T3-1 and a transistor T3-2, and the fourth transistor T4 includes a transistor T4-1 and a transistor T4-2.

The plurality of strobe lines are electrically connected to the plurality of pixel driving circuits. Specifically, the plurality of strobe lines include a plurality of first strobe lines GL1, a plurality of second strobe lines GL2, and a plurality of third strobe lines GL3.

The gate electrodes of the second transistors T2 of the plurality of pixel driving circuits in each pixel row PL are electrically connected to the same first strobe line GL1, the gate electrodes of the seven transistors T7 of the plurality of pixel driving circuits in each pixel row PL are electrically connected to the same first strobe line GL1, and the gate electrodes of the second transistors T2 and the gate electrodes of the seventh transistors T7 of each pixel driving circuit are electrically connected to different first strobe lines GL1. The second transistor T2 is configured to transmit a data signal according to the first strobe signal Scan1 of the corresponding first strobe line GL1 so that the first transistor T1 generates a driving current of controlling the sub-pixels PE to emit light according to the data signal. The seventh transistor T7 is configured to transmit a second reset signal to an anode the sub-pixels PE according to the first strobe signal Scan1 transmitted by the corresponding first strobe line GL1.

The gate electrodes of the third transistors T3 of the plurality of pixel driving circuits in each pixel row PL are electrically connected to a same second strobe line GL2, the gate electrodes of the fourth transistors T4 of the plurality of pixel driving circuits in each pixel row PL are electrically connected to the same second strobe line GL2, and the gate electrode of the third transistor T3 and the gate electrode of the fourth transistor T4 of each pixel driving circuit are electrically connected to different second strobe lines GL2. The third transistor T3 is configured to compensate a threshold value of the first transistor T1 according to the second strobe signal SE2 transmitted by the corresponding second strobe line GL2, and the fourth transistor T4 is configured to transmit the first reset signal to a gate electrode of the first transistor T1 according to the second strobe signal SE2 transmitted by the corresponding second strobe line GL2.

The gate electrodes of the fifth transistors T5 of the plurality of pixel driving circuits in each pixel row PL are electrically connected to the same third strobe line GL3, and the gate electrodes of the sixth transistors T6 of the plurality of pixel driving circuits in each pixel row PL are electrically connected to the same third strobe line GL3. Optionally, the gate electrode of the fifth transistor T5 and the gate electrode of the sixth transistor T6 of each pixel driving circuit are electrically connected to the same third strobe line GL3. The fifth transistor T5 and the sixth transistor T6 are configured to make the first transistor T1 provide the driving current to the sub-pixel PE according to a third strobe signal EM transmitted by the third strobe line GL3.

Optionally, active layers of the first transistor T1 to the seventh transistor T7 all include silicon semiconductors. Furthermore, the active layers of the first transistor T1 to the seventh transistor T7 all include low-temperature polycrystalline-silicon.

Illustrated in FIG. 4A to FIG. 4E are layout structural schematic diagrams of the strobe driving circuits provided by one embodiment of the present application. Optionally, the plurality of strobe driving circuits are located in the non-display region 100*b*. Please continue referring to FIG. 1, FIG. 2A to FIG. 2B, and FIG. 4A to FIG. 4E. The plurality of strobe driving circuits includes a plurality of first strobe driving circuits 201, a plurality of second strobe driving circuits 202, and a plurality of third strobe driving circuits 203.

The plurality of first strobe driving circuits 201 are cascaded. The plurality of cascaded first strobe driving circuits 201 respond to a first start signal STV1 to output a plurality of first strobe signals Scan1. The plurality of cascaded first strobe driving circuits 201 are electrically connected to the plurality of first strobe lines GL1 to transmit a plurality of first strobe signals Scant to the plurality of first strobe lines GL1. Optionally, the first strobe signal Scant can also be named as a scan signal. Optionally, the gate electrode of the second transistor T2 and the gate electrode of the seventh transistor T7 of each pixel driving circuit are electrically connected to the first strobe driving circuits 201 of different stages through different first strobe lines GL1. For example, the gate electrode of the second transistor T2 of the pixel driving circuit located in the M+1th pixel row is electrically connected to the first strobe driving circuit of the M+1th stage, and the gate electrode of the seventh transistor T7 of the pixel driving circuit located in the M+1th pixel row is electrically connected to the first strobe driving circuits of the Mth stage or the M+2th stage. Wherein, the first strobe driving circuit of the Mth stage outputs the first strobe signal Scan1(M) of the Mth stage, the first strobe driving circuit of the M+1th stage outputs the first strobe signal Scan1(M+1) of the M+1th stage, and the first strobe driving circuit of the M+2th stage outputs the first strobe signal Scan1(M+2) of the M+2th stage.

The plurality of second strobe driving circuits 202 are cascaded. The plurality of cascaded second strobe driving circuits 202 respond to a second start signal STV2 to output a plurality of second strobe signals SE2. The plurality of cascaded second strobe driving circuits 202 are electrically connected to the plurality of second strobe lines GL2 to transmit a plurality of second strobe signals SE2 to the plurality of second strobe lines GL2. Optionally, the second strobe signal SE2 is also named as a scan signal or an emission control signal.

Optionally, a circuit structure of the second strobe driving circuits 202 is same as a circuit structure of the first strobe driving circuits 201, the gate electrode of the third transistor T3 and the gate electrode of the fourth transistor T4 of each pixel driving circuit are electrically connected to the second strobe driving circuits 202 of different stages through different second strobe lines GL2. For example, the gate electrode of the third transistor T3 of the pixel driving circuit located in the M+1th pixel row is electrically connected to the second strobe driving circuit of the M+1th stage, and the gate electrode of the fourth transistor T4 of the pixel driving circuit located in the M+1th pixel row is electrically connected to the second strobe driving circuit of the Mth stage. Wherein, as illustrated in FIG. 2A and FIG. 4A to FIG. 4D, the second strobe driving circuit of the Mth stage outputs the second strobe signal SE2(M) of the Mth stage, the second strobe driving circuit of the M+1th stage outputs the second strobe signal SE2(M+1) of the M+1th stage.

Optionally, the plurality of second strobe driving circuits 202 can be cascaded in groups. For example, the plurality of second strobe driving circuits 202 electrically connected to the third transistors T3 in the plurality of pixel driving circuits are configured to be cascaded, and the plurality of second strobe driving circuits 202 electrically connected to the fourth transistors T4 in the plurality of pixel driving circuits are configured to be cascaded. Furthermore, the second strobe driving circuit 202 and the third strobe driving circuit 203 have a same circuit structure. The gate electrode of the third transistor T3 of the pixel driving circuit in the M+1th pixel row is electrically connected to a second strobe driving circuit of a Pth stage, and the gate electrode of the fourth transistor T4 of the pixel driving circuit in the M+1th pixel row is electrically connected to a second strobe driving circuit of the Oth stage. Wherein, as illustrated in FIG. 2B and FIG. 4E, the second strobe driving circuit of the Pth stage outputs a second strobe signal SE2_L(P), and the second strobe driving circuit of the Oth stage outputs a second strobe signal SE2_R(O), Optionally, when the second strobe driving circuit 202 and the third strobe driving circuit 203 have the same circuit structure, each of the second strobe driving circuits 202 is electrically connected to the plurality of the pixel driving circuits in adjacent two of the pixel rows PL.

The plurality of third strobe driving circuits 203 are cascaded. The plurality of cascaded third strobe driving circuits 203 respond to a third start signal STV3 to output a plurality of third strobe signals EM. The plurality of cascaded third strobe driving circuits 203 are electrically connected to the plurality of third strobe lines GL3 to transmit the plurality of third strobe signals EM to the plurality of third strobe lines GL3. Optionally, the third strobe signal EM can also be named as the emission control signal. Optionally, the gate electrode of the fifth transistor T5 and the gate electrode of the sixth transistor T6 of each pixel driving circuit are electrically connected to a same third strobe driving circuit 203 through a same third strobe line GL3. Optionally, each of the third strobe driving circuits 203 is electrically connected to the plurality of the pixel driving circuits in adjacent two of the pixel rows PL.

Figure 3A:
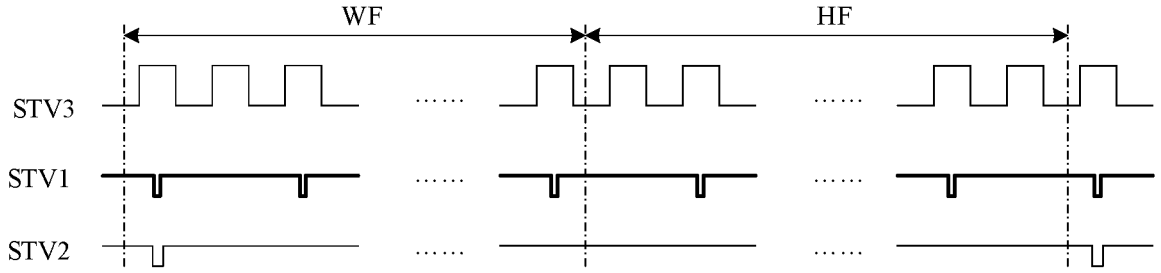
FIG. 3A is a sequence diagram of a first start signal, a second start signal, and a third start signal provided by one embodiment of the present application.
Figure 3B:
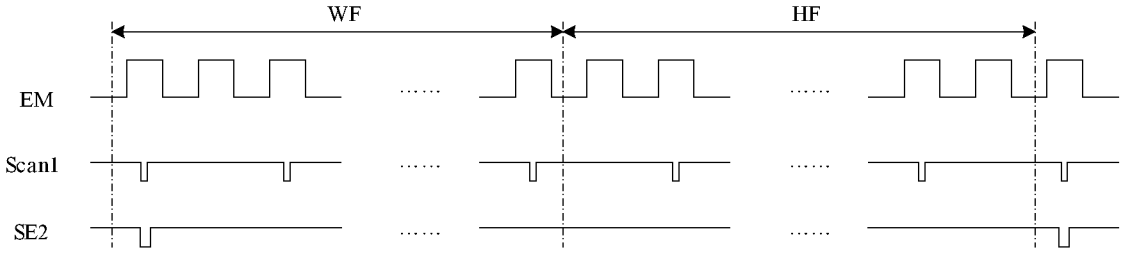
FIG. 3B to FIG. 3C is a sequence diagram of a first strobe signal, a second strobe signal, and a third strobe signal provided by one embodiment of the present application.
Figure 3C:
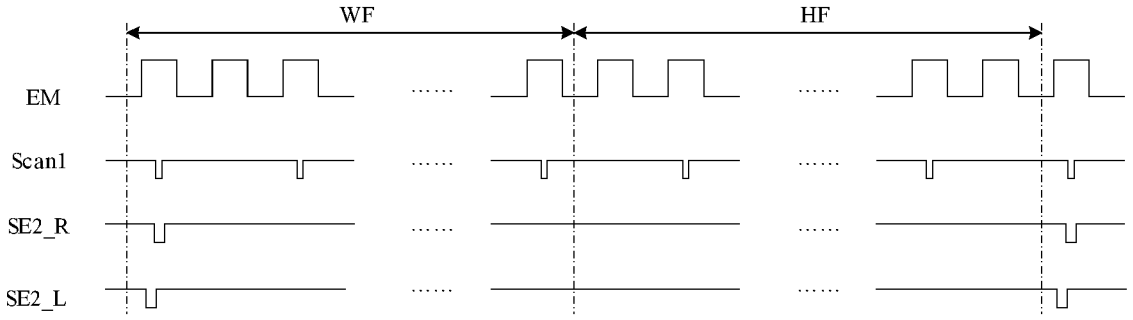

Illustrated in FIG. 3A is a sequence diagram of the first start signal, the second start signal, and the third start signal provided by one embodiment of the present application. Illustrated in FIG. 3B to FIG. 3C is a sequence diagram of the first strobe signal, the second strobe signal, and the third strobe signal provided by one embodiment of the present application. In order to ensure that the pixel driving circuit to work normally, in a writing frame WF and a holding frame HF, valid pulses (if T2, T3, T4, T7 are all P-type transistors, then there are valid pulses when STV1 and STV2 are in low electric levels) of the first start signal STV1 and the second start signal STV2 are in action time of invalid pulses (if T5 and T6 are P-type transistors, there are invalid pulses when STV3 is in a high electric level) of the third start signal STV3. Therefore, in the writing frame WF and the holding frame HF, valid pulses of the first strobe signal Scan1 and the second strobe signal SE2 are in the time of invalid pulses of the third strobe signal EM.

Optionally, a number of the valid pulses of the first start signal STV1 in the writing frame WF is single or multiple, and the first start signal STV1 is cyclical in the time sequence of the writing frame WF in the holding frame HF. Wherein, the writing frame WF corresponds to a frame including data writing stages, and the holding frame HF is a frame that does not include the data writing stage. Wherein, in the data writing stage, the second transistor T2 and the third transistor T3 in the pixel driving circuits are conductive, and the data signal transmitted by the data line DL is written into the gate electrode of the first transistor T1 through the second transistor T2 and the third transistor T3.

Because the first start signal STV1 is cyclical in the time sequence of the writing frame WF in the holding frame HF, a sum of a number of the valid pulses of the first start signal STV1 is greater than a sum of a number of the valid pulses of the second start signal STV2 in a period including the write frame WF and the holding frame HF.

In order to make the data signal be able to be written to the gate electrode of the first transistor T1 in the data writing stage, a first one of the valid pulses of the first start signal STV1 at least partially overlaps with the valid pulses of the second start signal STV2 in the writing frame WF, so the first one of the valid pulses of the first start signal STV1 is made to at least partially overlap with valid pulses of the second strobe signal SE2 in the writing frame WF, so that the second transistor T2 and the third transistor T3 can be conductive in a part of time. It can be understood that the plurality of strobe drive circuits can be designed by using the circuit structure in the prior art, and redundant description will not be mentioned herein again.

Please continue referring to FIG. 1 and FIG. 4A to FIG. 4E. A number of the first gate strobe circuits 201 of a same stage electrically connected to the plurality of the pixel driving circuits in a same pixel row PL is at most two, a number of the plurality of second gate strobe circuits 202 of a same stage electrically connected to the plurality of the pixel driving circuits located in the same pixel row PL is at most two, and a number of the plurality of third gate strobe circuits 203 of a same stage electrically connected to the plurality of the pixel driving circuits located in the same pixel row PL is at most two. By performing layout configuration on the plurality of strobe driving circuits electrically connected to the plurality of pixel driving circuits of one same pixel row PL, the first gate strobe circuits 201 of the same stage, the second gate strobe circuits 202 of the same stage, and the third gate strobe circuits 203 of the same stage electrically connected to the plurality of the pixel driving circuits in the same pixel row are made to control to be at most two, which is conducive to realizing a narrow bezel design when the dynamic refresh rates are adopted in the display panel.

Optionally, the non-display region 100*b* includes a first non-display region 1001*b* and a second non-display region 1002*b* located on two opposite sides of the display region 100*a*. Wherein, there is a first row number of the plurality of strobe driving circuits located in the first non-display region 1001*b*, there is a second row number of the plurality of strobe driving circuits located in the second non-display region 1002*b*, and the first row number is equal to the second row number, which is conducive to making the first non-display region 1001*b* and the second non-display region 1002*b* to have same widths and/or lengths and is conducive to realizing symmetrical configuration of the first non-display region 1001*b* and the second non-display region 1002*b*.

With reference to FIG. 4A to 4E, the layout of the plurality of the strobe drive circuits are described as follow. Wherein, CL1, CL2 and CL3 in FIG. 4A to FIG. 4E respectively represent cascade connection lines between the plurality of first strobe driving circuits 201, cascade connection lines between the plurality of second strobe driving circuits 202, and cascade connection lines between the plurality of third strobe driving circuits 203.

First, the structure illustrated in FIG. 2A is adopted in the pixel driving circuit for description. A circuit structure of the second strobe driving circuits 202 is same as a circuit structure of the first strobe driving circuits 201. Different arrangement manner can be adopted to dispose the first strobe driving circuit 201, the second strobe driving circuit 202 and the third strobe driving circuit 203 electrically connected to the plurality of pixel driving circuits in the same pixel row PL in the first non-display region 1001*b* and the second non-display region 1002*b*.

Figure 4A:
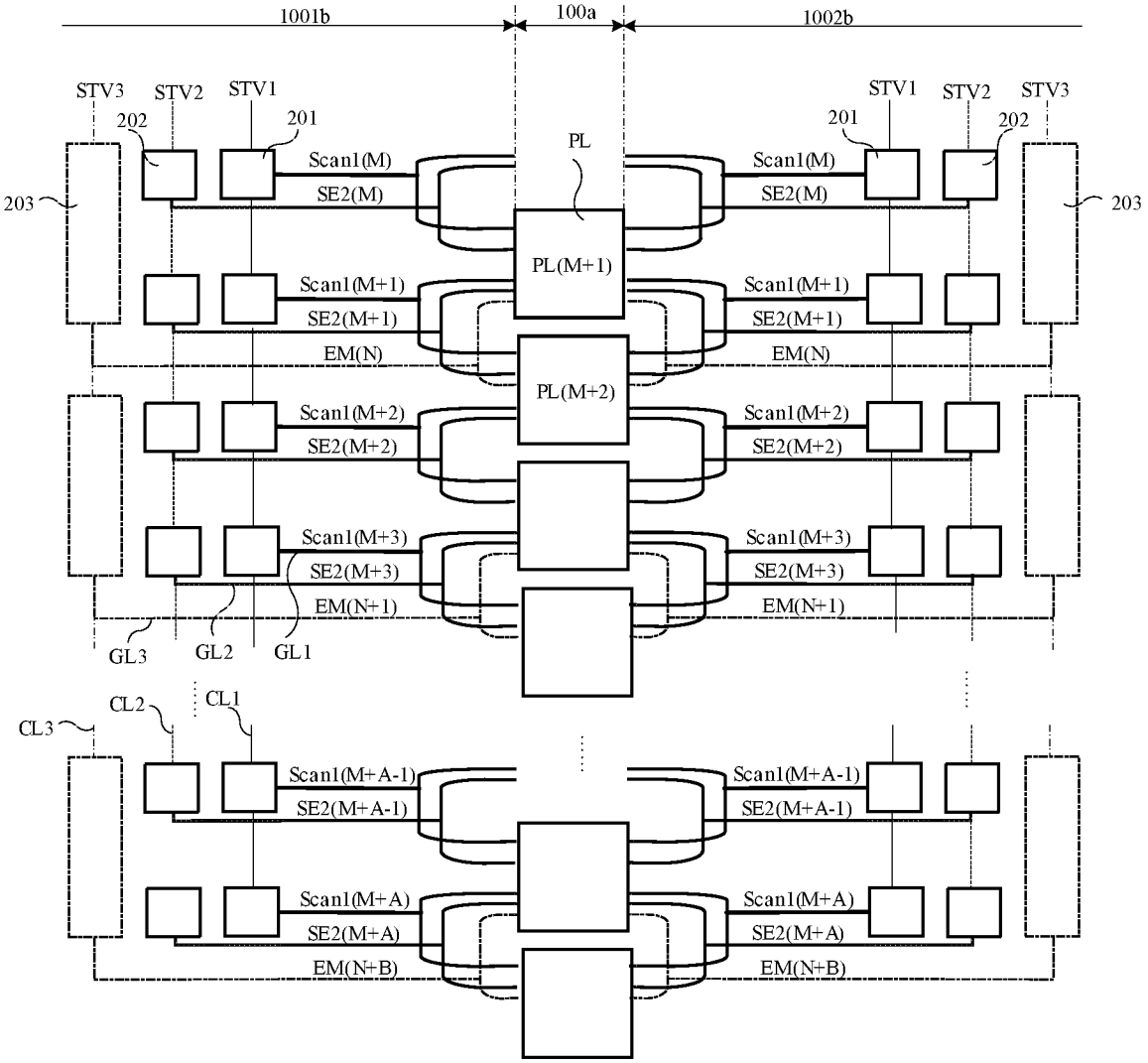
FIG. 4A to FIG. 4E are layout structural schematic diagrams of strobe driving circuits provided by one embodiment of the present application.

Specifically, please continue referring to FIG. 4A. Two of the first strobe driving circuits 201 of a same stage electrically connected to the plurality of pixel driving circuits of a same pixel row PL are respectively located in the first non-display region 1001*b* and the second non-display region 1002*b*. Two of the second strobe driving circuits 202 of a same stage electrically connected to the pixel driving circuits of a same pixel row PL are respectively located in the first non-display region 1001*b* and the second non-display region 1002*b*. Two of the third strobe driving circuits 203 of a same stage electrically connected to the plurality of pixel driving circuits of a same pixel row PL are respectively located in the first non-display region 1001*b* and the second non-display region 1002*b*.

Wherein, in the first non-display region 1001*b* and the second non-display region 1002*b*, the second strobe driving circuit 202 is located between the first strobe driving circuit 201 and the third strobe driving circuit 203, the third strobe driving circuits 203 are located on a side of the second strobe driving circuits 202 away from the display region 100*a*.

Furthermore, the pixel driving circuits located in the M+1th pixel row PL(M+1) and the M+2th pixel row PL(M+2) are taken as an example for description. The gate electrode of the second transistor T2 in the plurality of pixel driving circuits in the M+1th pixel row PL(M+1) is electrically connected to the first strobe driving circuits of the M+1th stage located in the first non-display region 1001*b* and the second non-display region 1002*b*. The gate electrode of the second transistor T2 in the plurality of pixel driving circuits in the M+2th pixel row PL(M+2) is electrically connected to the first strobe driving circuits of the M+2th stage located in the first non-display region 1001*b* and the second non-display region 1002*b*. The first strobe driving circuit of the M+2th stage provides the first strobe signal Scan1(M+2) of the M+2th stage.

The gate electrode of the seventh transistor T7 in the plurality of pixel driving circuits in the M+1th pixel row PL(M+1) is electrically connected to the first strobe driving circuits of the Mth stage located in the first non-display region 1001*b* and the second non-display region 1002*b*. The gate electrode of the seventh transistor T7 in the plurality of pixel driving circuits in the M+2th pixel row PL(M+2) is electrically connected to the first strobe driving circuits of the M+1th stage located in the first non-display region 1001*b* and the second non-display region 1002*b*.

The gate electrode of the third transistor T3 in the plurality of pixel driving circuits in the M+1th pixel row PL(M+1) is electrically connected to the second strobe driving circuits of the M+1th stage located in the first non-display region 1001*b* and the second non-display region 1002*b*. The gate electrode of the third transistor T3 in the plurality of pixel driving circuits in the M+2th pixel row PL(M+2) is electrically connected to the second strobe driving circuits of the M+2th stage located in the first non-display region 1001*b* and the second non-display region 1002*b*. The second strobe driving circuit of the M+2th stage provides the second strobe signal SE2(M+2) of the M+2th stage.

The gate electrode of the fourth transistor T4 in the plurality of pixel driving circuits in the M+1th pixel row PL(M+1) is electrically connected to the second strobe driving circuits of the Mth stage located in the first non-display region 1001*b* and the second non-display region 1002*b*. The gate electrode of the fourth transistor T4 in the plurality of pixel driving circuits in the M+2th pixel row PL(M+2) is electrically connected to the second strobe driving circuits of the M+1th stage located in the first non-display region 1001*b* and the second non-display region 1002*b*.

The gate electrode of the fifth transistor T5 and the gate electrode of the sixth transistor T6 in the plurality of pixel driving circuits in the M+1th pixel row PL(M+1) are electrically connected to the third strobe driving circuits of the Nth stage located in the first non-display region 1001*b* and the second non-display region 1002*b*. The third strobe driving circuit of the Nth stage provides the third strobe signal EM(N) of the Nth stage. The gate electrode of the fifth transistor T5 and the gate electrode of the sixth transistor T6 in the plurality of pixel driving circuits in the M+2th pixel row PL(M+2) are electrically connected to the third strobe driving circuits of the Nth stage located in the first non-display region 1001*b* and the second non-display region 1002*b*. Wherein, M is greater than or equal to 0, and N is greater than or equal to 0. A in FIG. 4A to FIG. 4E is equal to 4, 5, 6, . . . etc., and B is equal to 2, 3, 4, . . . etc.

Because one of the third strobe driving circuits 203 can be electrically connected to the plurality of the pixel driving circuits of two adjacent pixel rows PL, disposing the third strobe driving circuit 203 on the side of the second strobe driving circuit 202 away from the display region 100*a* can reduce probability that the first strobe line GL1, the second strobe line GL2, and the first gate line GL1 overlap with the third strobe driving circuits 203.

Optionally, as the plurality of first strobe driving circuits 201, the plurality of second strobe driving circuits 202, and the plurality of third strobe driving circuits 203 are all configured stage by stage in the first non-display region 1001*b* and the second non-display region 1002*b*, so in order to reduce wiring difficulty and reduce wiring distance, the plurality of first strobe driving circuits 201 are cascaded row by row respectively in the first non-display region 1001*b* and the second non-display region 1002*b*, the plurality of second strobe driving circuits 202 are cascaded row by row respectively in the first non-display region 1001*b* and the second non-display region 1002*b*, and the plurality of third strobe driving circuits 203 are cascaded row by row respectively in the first non-display region 1001*b* and the second non-display region 1002*b*.

Figure 4B:
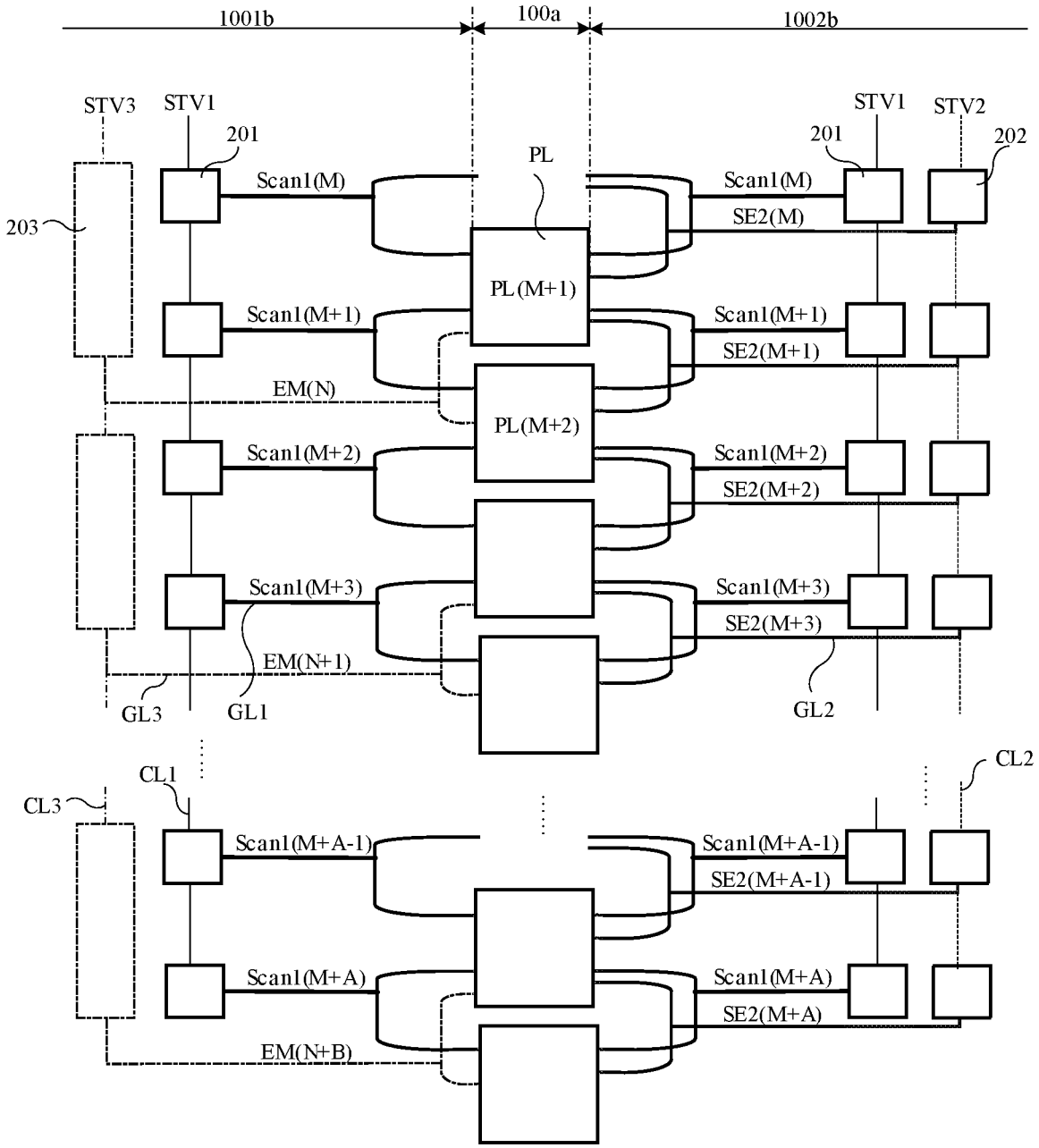

Specifically, please continue referring to FIG. 4B. Two of the first strobe driving circuits 201 of a same stage electrically connected to the plurality of pixel driving circuits of a same pixel row PL are respectively located in the first non-display region 1001*b* and the second non-display region 1002*b*. The number of the second gate strobe circuits 202 of the same stage electrically connected to the plurality of the pixel driving circuits located in the same pixel rows PL is one, and the number of the third gate strobe circuits 203 of the same stage electrically connected to the plurality of the pixel driving circuits located in the same pixel rows PL is one.

Wherein, the plurality of the second strobe driving circuits 202 are all located in the second non-display region 1002*b*, the plurality of third strobe driving circuits 203 are all located in the first non-display region 1001*b*, and the plurality of second strobe driving circuits 202 and the plurality of third strobe driving circuits 203 are all located on a side of the plurality of first strobe driving circuits 201 away from the display region 100*a*.

Optionally, the plurality of first strobe driving circuits 201 located in the first non-display region 1001*b* and the second non-display region 1002*b* are symmetrically disposed about the display region 100*a*, so that the first strobe signals Scan1 transmitted to the display region 100*a* through the corresponding first strobe line by two first strobe driving circuits 201 of a same stage in the first non-display region 1001*b* and the second non-display region 1002*b* have similar losses, which makes the display panel has better display quality.

Furthermore, the pixel driving circuits located in the M+1th pixel row PL(M+1) and the M+2th pixel row PL(M+2) are is still taken as an example for description. Wherein, the gate electrode of the second transistor T2 and the gate electrode of the seventh transistor T7 in the plurality of pixel driving circuits located in the M+1th pixel row PL(M+1) and the M+2th pixel row PL(M+2) are similar to the connection form illustrated in FIG. 4A, and redundant description will not be mentioned herein again.

The gate electrode of the third transistor T3 in the plurality of pixel driving circuits in the M+1th pixel row PL(M+1) is electrically connected to the second strobe driving circuits of the M+1th stage in the second non-display region 1002*b*. The gate electrode of the third transistor T3 in the plurality of pixel driving circuits in the M+2th pixel row PL(M+2) is electrically connected to the second strobe driving circuits of the M+2th stage in the second non-display region 1002*b*.

The gate electrode of the fourth transistor T4 in the plurality of pixel driving circuits in the M+1th pixel row PL(M+1) is electrically connected to the second strobe driving circuits of the Mth stage in the second non-display region 1002*b*. The gate electrode of the fourth transistor T4 in the plurality of pixel driving circuits in the M+2th pixel row PL(M+2) is electrically connected to the second strobe driving circuits of the M+1th stage in the second non-display region 1002*b*.

The gate electrode of the fifth transistor T5 and the gate electrode of the sixth transistor T6 in the plurality of pixel driving circuits in the M+1th pixel row PL(M+1) and the M+2th pixel row PL(M+2) are both electrically connected to the third strobe driving circuits of the Nth stage in the first non-display region 1001*b*.

Optionally, as the plurality of first strobe driving circuits 201 are included in the first non-display region 1001*b* and the second non-display region 1002*b*, and the plurality of first strobe driving circuits 201 in the first non-display region 1001*b* and the second non-display region 1002*b* are all cascaded stage by stage, so the plurality of first strobe driving circuits 201 located in the first non-display region 1001*b* and the second non-display region 1002*b* are cascaded row by row respectively. As the plurality of the second strobe driving circuits 202 are all located in the second non-display region 1002*b*, and the plurality of second strobe driving circuits 202 are cascaded stage by stage, so the plurality of second strobe driving circuits 202 can be cascaded row by row. As the plurality of the third strobe driving circuits 203 are all located in the first non-display region 1001*b*, and the plurality of third strobe driving circuits 203 are cascaded stage by stage, so the plurality of third strobe driving circuits 203 can be cascaded row by row.

Optionally, in the writing frame WF and the holding frame HF, when the number of the valid pulses of the first start signal STV1 is single or multiple, as the plurality of first strobe driving circuits 201 are included in the first non-display region 1001*b* and the second non-display region 1002*b*, the plurality of first strobe signals Scan1 transmitted to the display panel have similar losses, and can also better compensate an anode voltage and a gate voltage of light-emitting devices.

Figure 4C:
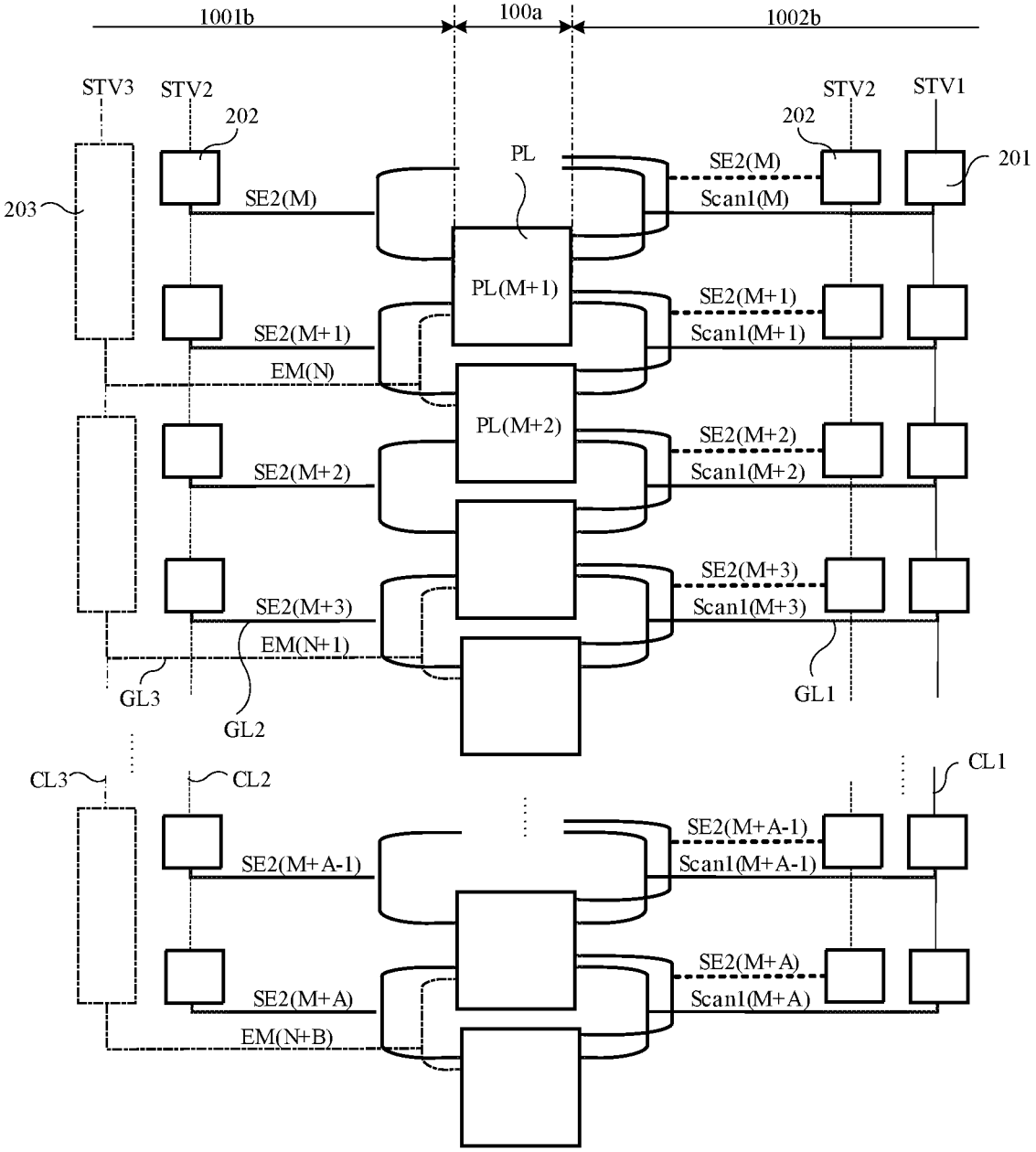

Specifically, please continue referring to FIG. 4C. Two of the second strobe driving circuits 202 of a same stage electrically connected to the pixel driving circuits of a same pixel row PL are respectively located in the first non-display region 1001*b* and the second non-display region 1002*b*. The number of the first gate strobe circuits 201 of the same stage electrically connected to the plurality of the pixel driving circuits located in the same pixel rows PL is one, and the number of the third gate strobe circuits 203 of the same stage electrically connected to the plurality of the pixel driving circuits located in the same pixel rows PL is one.

Wherein, the plurality of the first strobe driving circuits 201 are all located in the second non-display region 1002*b*, the plurality of third strobe driving circuits 203 are all located in the first non-display region 1001*b*, and the plurality of first strobe driving circuits 201 and the plurality of third strobe driving circuits 203 are all located on a side of the plurality of second strobe driving circuits 202 away from the display region 100*a*. The plurality of second strobe driving circuits 202 located in the first non-display region 1001*b* and the second non-display region 1002*b* are symmetrically disposed about the display region 100*a*, so that the second strobe signals Scan2 transmitted to the display region 100*a* through the corresponding second strobe line by two second strobe driving circuits 202 of a same stage located in the first non-display region 1001*b* and the second non-display region 1002*b* have similar losses, which makes the display panel has better display quality.

Furthermore, the pixel driving circuits located in the M+1th pixel row PL(M+1) and the M+2th pixel row PL(M+2) are is still taken as an example for description. Wherein, the gate electrode of the third transistor T3 and the gate electrode of the fourth transistor T4 in the plurality of pixel driving circuits located in the M+1th pixel row PL(M+1) and the M+2th pixel row PL(M+2) are similar to the connection form illustrated in FIG. 4A, the gate electrode of the fifth transistor T5 and the gate electrode of the sixth transistor T6 in the plurality of pixel driving circuits located in the M+1th pixel row PL(M+1) and the M+2th pixel row PL(M+2) are similar to the connection form illustrated in FIG. 4B, and redundant description will not be mentioned herein again.

The gate electrode of the second transistor T2 in the plurality of pixel driving circuits in the M+1th pixel row PL(M+1) is electrically connected to the first strobe driving circuits of the M+1th stage in the second non-display region 1002*b*. The gate electrode of the second transistor T2 in the plurality of pixel driving circuits in the M+2th pixel row PL(M+2) is electrically connected to the first strobe driving circuits of the M+2th stage in the second non-display region 1002*b*.

The gate electrode of the seventh transistor T7 in the plurality of pixel driving circuits in the M+1th pixel row PL(M+1) is electrically connected to the first strobe driving circuits of the Mth stage in the second non-display region 1002*b*. The gate electrode of the seventh transistor T7 in the plurality of pixel driving circuits in the M+2th pixel row PL(M+2) is electrically connected to the first strobe driving circuits of the M+1th stage in the second non-display region 1002*b*.

Optionally, as the plurality of first strobe driving circuits 201 are all located in the second non-display region 1002*b*, and the plurality of first strobe driving circuits 201 are cascaded stage by stage, so the plurality of first strobe driving circuits 201 can be cascaded row by row. As the plurality of second strobe driving circuits 202 are included in the first non-display region 1001*b* and the second non-display region 1002*b*, and the plurality of second strobe driving circuits 202 in the first non-display region 1001*b* and the second non-display region 1002*b* are all cascaded stage by stage, so the plurality of second strobe driving circuits 202 located in the first non-display region 1001*b* and the second non-display region 1002*b* are cascaded row by row respectively. As the plurality of the third strobe driving circuits 203 are all located in the first non-display region 1001*b*, and the plurality of third strobe driving circuits 203 are cascaded stage by stage, so the plurality of third strobe driving circuits 203 can be cascaded row by row.

Compared to the arrangement manner of FIG. 4A to FIG. 4B, in the arrangement manner of FIG. 4C, the plurality of first strobe driving circuits 201 are only located in the second non-display region 1002*b*. When the anode voltage of the light-emitting devices and the gate voltage of the driving transistors in the writing frame WF and the holding frame HF are compensated, the number of the related first strobe driving circuits 201 is small, which can reduce the power consumption of the display panel.

Figure 4D:
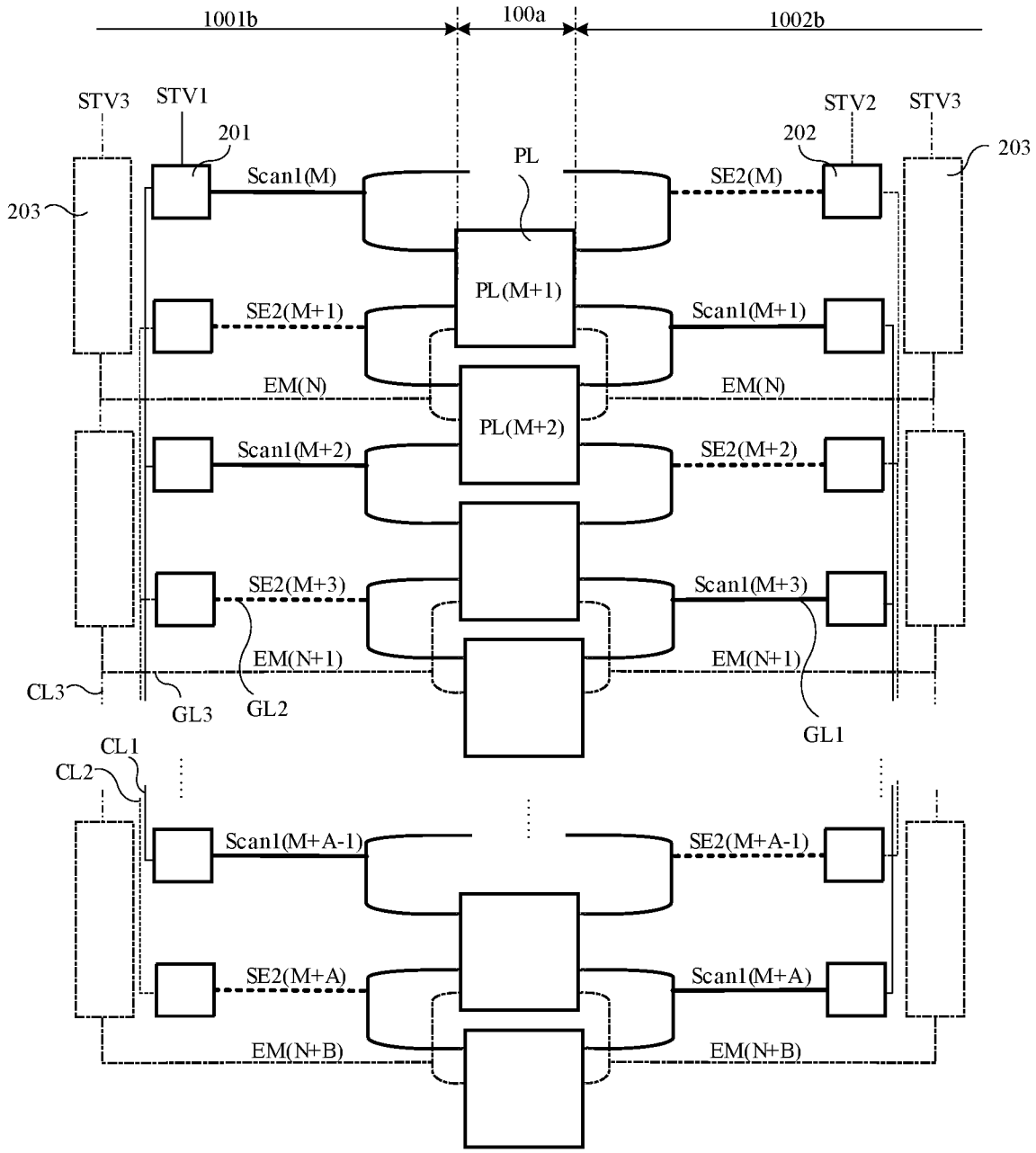
Figure 4E:
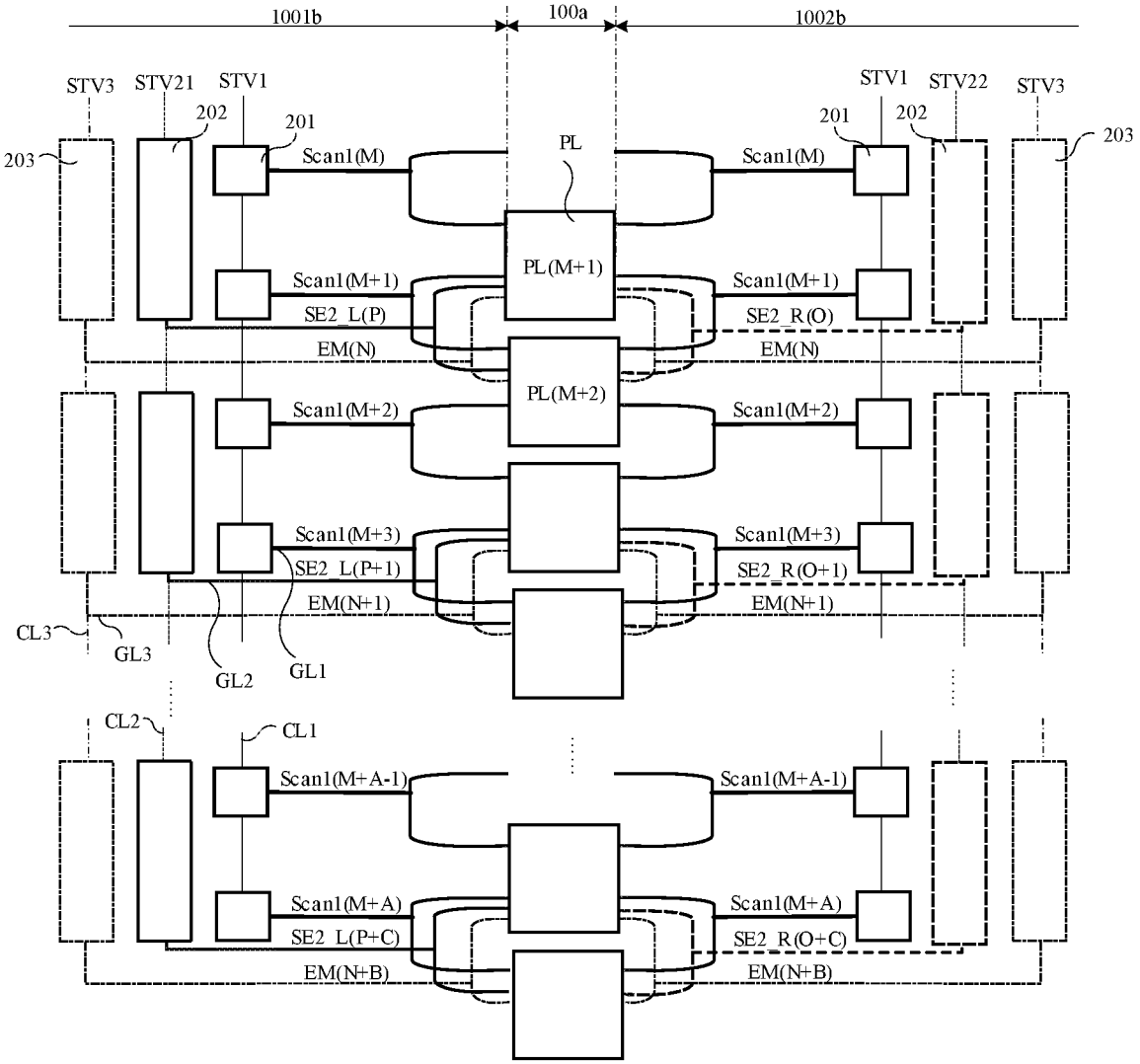

Please refer to FIG. 4D. Two of the third strobe driving circuits 203 of a same stage electrically connected to the plurality of pixel driving circuits of a same pixel row PL are respectively located in the first non-display region 1001*b* and the second non-display region 1002*b*. The number of the first gate strobe circuits 201 of the same stage electrically connected to the plurality of the pixel driving circuits located in the same pixel rows PL is one, and the number of the second gate strobe circuits 202 of the same stage electrically connected to the plurality of the pixel driving circuits located in the same pixel rows PL is one.

Optionally, the plurality of first strobe driving circuits 201 are all located in the first non-display region 1001*b*, and the plurality of the second strobe driving circuits 202 are all located in the second non-display region 1002*b*. Optionally, the plurality of first strobe driving circuits 201 located in the first non-display region 1001*b* are cascaded row by row, and the plurality of second strobe driving circuits 202 located in the second non-display region 1002*b* are cascaded row by row.

Optionally, as illustrated in FIG. 4D, the plurality of first strobe driving circuits 201 and the plurality of second strobe driving circuits 202 are disposed alternately in the first non-display region 1001*b* and the second non-display region 1002*b*, and the plurality of first strobe driving circuits 201 and the plurality of second strobe driving circuits 202 are all located on a side of the plurality of third strobe driving circuits 203 close to the display region 100*a*. Optionally, the plurality of first strobe driving circuits 201 located in the first non-display region 1001*b* and the second non-display region 1002*b* are cascaded every other line respectively, and the plurality of second strobe driving circuits 202 located in the first non-display region 1001*b* and the second non-display region 1002*b* are cascaded every other line respectively.

Optionally, the plurality of third strobe driving circuits 203 are cascaded every other line respectively in the first non-display region 1001*b* and the second non-display region 1002*b*. Wherein, the connection form of each transistor in the plurality of pixel driving circuits in the plurality of pixel rows PL in FIG. 4D can refer to the description of FIG. 4A to FIG. 4C, and redundant description will not be mentioned herein again.

The structure illustrated in FIG. 2B is adopted in the pixel driving circuit for description. A circuit structure of the second strobe driving circuits 202 is same as a circuit structure of the third strobe driving circuits 203. Two of the first strobe driving circuits 201 of a same stage electrically connected to the plurality of pixel driving circuits of a same pixel row PL are respectively located in the first non-display region 1001*b* and the second non-display region 1002*b*. The second strobe driving circuit 202 electrically connected to the gate electrode of the third transistor T3 of the plurality of pixel driving circuits in the same pixel row PL, and the second strobe driving circuit 202 electrically connected to the gate electrode of the fourth transistor T4 of the plurality of pixel driving circuits in the same pixel row PL are respectively located in the the first non-display region 1001*b* and the second non-display region 1002*b*. Two of the third strobe driving circuits 203 of a same stage electrically connected to the plurality of pixel driving circuits of a same pixel row PL are respectively located in the first non-display region 1001*b* and the second non-display region 1002*b*.

Wherein, as illustrated in FIG. 4E, in the first non-display region 1001*b* and the second non-display region 1002*b*, the second strobe driving circuit 202 is located between the first strobe driving circuit 201 and the third strobe driving circuit 203, and the third strobe driving circuits 203 are located on a side of the second strobe driving circuits 202 away from the display region 100*a*. Wherein, P in FIG. 4E is greater than or equal to 0, 0 is greater than or equal to 0, and C can be equal to 2, 3, 4, etc.

Furthermore, the pixel driving circuits located in the M+1th pixel row PL(M+1) and the M+2th pixel row PL(M+2) are taken as an example for description. Wherein, the gate electrode of the second transistor T2, the gate electrode of the fifth transistor T5, the gate electrode of the sixth transistor T6, and the gate electrode of the seventh transistor T7 in the plurality of pixel driving circuits located in the M+1th pixel row PL(M+1) and the M+2th pixel row PL(M+2) are similar to the connection form illustrated in FIG. 4A, and redundant description will not be mentioned herein again.

The gate electrode of the third transistor T3 located in the plurality of pixel driving circuits in the M+1th pixel row PL(M+1) and the M+2th pixel row PL(M+2) are both electrically connected to the second strobe driving circuits of the Pth stage located in the first non-display region 1001*b*.

The gate electrode of the fourth transistor T4 located in the plurality of pixel driving circuits in the M+1th pixel row PL(M+1) and the M+2th pixel row PL(M+2) are both electrically connected to the second strobe driving circuits of the Oth stage located in the second non-display region 1002*b*.

Compared to one of the second strobe driving circuits 202 electrically connected to the plurality of the pixel driving circuits in one of the pixel rows PL illustrated in FIG. 4A to FIG. 4D, one of the second strobe driving circuits 202 electrically connected to the plurality of the pixel driving circuits of two adjacent pixel rows PL is illustrated in FIG. 4E, so a refresh rate of the second strobe signal SE2 outputted by the second strobe driving circuit 202 illustrated in FIG. 4 is small, which can reduce power consumption of the display panel.

Optionally, the plurality of first strobe driving circuits 201 located in the first non-display region 1001*b* and the second non-display region 1002*b* are cascaded row by row respectively, the plurality of second strobe driving circuits 202 located in the first non-display region 1001*b* and the second non-display region 1002*b* are cascaded row by row respectively, and the plurality of third strobe driving circuits 203 located in the first non-display region 1001*b* and the second non-display region 1002*b* are cascaded row by row respectively. As the plurality of second strobe driving circuits 202 located in the first non-display region 1001*b* and the plurality of second strobe driving circuits 202 located in the second non-display region 1002*b* are electrically connected to gate electrodes of the third transistor T3 and the fourth transistor T4 respectively, so the second start signal corresponding to the plurality of second strobe driving circuits 202 located in the first non-display region 1001*b* can be STV21, and the second start signal corresponding to the plurality of second strobe driving circuits 202 located in the second non-display region 1002*b* can be STV22. Wherein, time sequences of STV21 and STV22 are different, which makes the third transistor T3 and the fourth transistor T4 can be turned on time-divisionally.

Compared to the layout illustrated in FIG. 4B to FIG. 4D, the layout manner illustrated in FIG. 4A can make loss of the strobe signals transmitted to the display panel be small, and is more suitable for a large-sized display panel.

As the layout manner illustrated in FIG. 4A and FIG. 4E, the first row number of the plurality of strobe driving circuits located in the first non-display region 1001*b* is 3, and the second row number of the plurality of strobe driving circuits located in the second non-display region 1002*b* is 3. In the layout manner illustrated in FIG. 4B to FIG. 4D, the first row number of the plurality of strobe driving circuits located in the first non-display region 1001*b* is 2, and the second row number of the plurality of strobe driving circuits located in the second non-display region 1002*b* is 2. Therefore, compared to the layout manner illustrated in FIG. 4A and FIG. 4E, the layout manner illustrated in FIG. 4B to FIG. 4D is more conducive to realizing the narrow bezel design in the display panel.

The present application further provides a display device. The display device includes any aforesaid pixel driving circuit or any aforesaid display panel. The display device includes a time schedule controller. The time schedule controller is electrically connected to the plurality of strobe driving circuits.

The time schedule controller receives input image signals, converts a data format of the input image signals into a data format suitable for interfaces between the time schedule controller and the data driving circuit, and generates image data and various control signals. The plurality of the strobe driving circuits receive control signals from the time schedule controller to generate a plurality of strobe signals. The control signals received by the plurality of strobe driving circuits from the time schedule controller include a first start signal STV1 to a third start signal STV3 and are configured to determine clock signals of time sequence outputted by the plurality of strobe signals. The data driving circuit receives the data control signals and image data from the time schedule controller. The data driving circuit converts the image data into the data signals and outputs the data signals to a plurality of data lines. Wherein, the data signal is an analog voltage corresponding to a grayscale value of the image data.

It can be understood that the display device includes a movable display device (such as a notebook computer, a mobile phone, etc.), a fixed terminal (such as a desktop computer, a television, etc.), a measurement device (such as a sports bracelet, a thermometer, etc.), etc.

The principle and implementation manner of present application are described herein with reference to specific embodiments. The description of the embodiments mentioned above is only for helping to understand the method and the core idea of the present application. Contents of the specification shall not be construed as a limitation to the present application.

What is claimed is:

1. A display panel, comprising:

a plurality of strobe driving circuits comprising a plurality of cascaded first strobe driving circuits, a plurality of cascaded second strobe driving circuits, and a plurality of cascaded third strobe driving circuits, wherein the plurality of cascaded first strobe driving circuits respond to a first start signal to output a plurality of first strobe signals, the plurality of cascaded second strobe driving circuits respond to a second start signal to output a plurality of second strobe signals, the plurality of cascaded third strobe driving circuits respond to a third start signal to output a plurality of third strobe signals; in a writing frame and a holding frame, valid pulses of the first start signal and valid pulses of the second start signal are in action time of invalid pulses of the third start signal; and a plurality of pixel rows, wherein each of the plurality of pixel rows comprises a plurality of sub-pixels and a plurality of pixel driving circuits electrically connected to the plurality of sub-pixels, each of the pixel driving circuits comprises a first transistor, a second transistor, a third transistor, a fourth transistor, a fifth transistor, a sixth transistor, and a seventh transistor; the second transistor responds to corresponding one of the plurality of first strobe signals to transmit a data signal so that the first transistor generates a driving current of controlling the plurality of sub-pixels to emit light according to the data signal, the third transistor responds to corresponding one of the plurality of second strobe signals to compensate a threshold value of the first transistor, the fourth transistor responds to corresponding one of the plurality of second strobe signals to transmit a first reset signal to a gate electrode of the first transistor, the fifth transistor and the sixth transistor simultaneously respond to same corresponding one of the plurality of third strobe signals so that the first transistor provides the driving current to the plurality of sub-pixels, and the seventh transistor responds to corresponding one of the plurality of first strobe signals to transmit a second reset signal to an anode of the plurality of sub-pixels; and wherein stages of the plurality of first strobe signals responded by the second transistor and the seventh transistor are different, stages of the plurality of second strobe signals responded by the third transistor and the fourth transistor are different, each of the plurality of third strobe driving circuits is electrically connected to the plurality of the pixel driving circuits in adjacent two of the plurality of pixel rows; a number of the plurality of first gate strobe circuits of a same stage electrically connected to the plurality of the pixel driving circuits located in a same one of the plurality of pixel rows is at most two, a number of the plurality of second gate strobe circuits of a same stage electrically connected to the plurality of the pixel driving circuits located in the same one of the plurality of pixel rows is at most two, and a number of the plurality of third gate strobe circuits of a same stage electrically connected to the plurality of the pixel driving circuits located in the same one of the plurality of pixel rows is at most two.

2. The display panel as claimed in claim 1, wherein the display panel comprises:

a display region, wherein the plurality of pixel rows are located in the display region; and a non-display region located on periphery of the display region, wherein the plurality of strobe driving circuits are located in the non-display region, the non-display region comprises a first non-display region and a second non-display region located on two opposite sides of the display region; and wherein there is a first row number of the plurality of strobe driving circuits located in the first non-display region, there is a second row number of the plurality of strobe driving circuits located in the second non-display region, and the first row number is equal to the second row number.

3. The display panel as claimed in claim 2, wherein a circuit structure of the plurality of second strobe driving circuits is same as a circuit structure of the plurality of first strobe driving circuits, two of the plurality of first strobe driving circuits of a same stage electrically connected to the plurality of pixel driving circuits of a same one of the plurality of pixel rows are respectively located in the first non-display region and the second non-display region, two of the plurality of second strobe driving circuits of a same stage electrically connected to the plurality of pixel driving circuits of a same one of the plurality of pixel rows are respectively located in the first non-display region and the second non-display region, and two of the plurality of third strobe driving circuits of a same stage electrically connected to the plurality of pixel driving circuits of a same one of the plurality of pixel rows are respectively located in the first non-display region and the second non-display region; and wherein in the first non-display region and the second non-display region, the plurality of second strobe driving circuits are located between the plurality of first strobe driving circuits and the plurality of third strobe driving circuits, and the plurality of third strobe driving circuits are located on sides of the plurality of second strobe driving circuits away from the display region.

4. The display panel as claimed in claim 2, wherein a circuit structure of the plurality of second strobe driving circuits is same as a circuit structure of the plurality of third strobe driving circuits, two of the plurality of first strobe driving circuits of a same stage electrically connected to the plurality of pixel driving circuits of a same one of the plurality of pixel rows are respectively located in the first non-display region and the second non-display region; and one of the plurality of second strobe driving circuits electrically connected to the third transistor of the plurality of pixel driving circuits located in a same one of the plurality of pixel rows, and one of the plurality of second strobe driving circuits electrically connected to the fourth transistor of the plurality of pixel driving circuits located in a same one of the plurality of pixel rows are respectively located in the first non-display region and the second non-display region; and two of the plurality of third strobe driving circuits of a same stage electrically connected to the plurality of pixel driving circuits of a same one of the plurality of pixel rows are respectively located in the first non-display region and the second non-display region; and wherein in the first non-display region and the second non-display region, the plurality of second strobe driving circuits are located between the plurality of first strobe driving circuits and the plurality of third strobe driving circuits, and the plurality of third strobe driving circuits are located on a side of the plurality of second strobe driving circuits away from the display region.

5. The display panel as claimed in claim 2, wherein two of the plurality of first strobe driving circuits of a same stage electrically connected to the plurality of pixel driving circuits of a same one of the plurality of pixel rows are respectively located in the first non-display region and the second non-display region, the number of the plurality of second gate strobe circuits of the same stage electrically connected to the plurality of the pixel driving circuits located in the same one of the plurality of pixel rows is one, and the number of the plurality of third gate strobe circuits of the same stage electrically connected to the plurality of the pixel driving circuits located in the same one of the plurality of pixel rows is one; and wherein the plurality of the second strobe driving circuits are all located in the second non-display region, the plurality of third strobe driving circuits are all located in the first non-display region, and the plurality of second strobe driving circuits and the plurality of third strobe driving circuits are all located on a side of the plurality of first strobe driving circuits away from the display region.

6. The display panel as claimed in claim 2, wherein two of the plurality of second strobe driving circuits of the same stage electrically connected to the plurality of pixel driving circuits of the same one of the plurality of pixel rows are respectively located in the first non-display region and the second non-display region, and the number of the plurality of first gate strobe circuits of the same stage electrically connected to the plurality of the pixel driving circuits located in the same one of the plurality of pixel rows is one, and the number of the plurality of third gate strobe circuits of the same stage electrically connected to the plurality of the pixel driving circuits located in the same one of the plurality of pixel rows is one; and wherein the plurality of the first strobe driving circuits are all located in the second non-display region, the plurality of third strobe driving circuits are all located in the first non-display region, and the plurality of first strobe driving circuits and the plurality of third strobe driving circuits are all located on a side of the plurality of second strobe driving circuits away from the display region.

7. The display panel as claimed in claim 2, wherein two of the plurality of third strobe driving circuits of a same stage electrically connected to the plurality of pixel driving circuits of a same one of the plurality of pixel rows are respectively located in the first non-display region and the second non-display region; and the number of the plurality of first gate strobe circuits of the same stage electrically connected to the plurality of the pixel driving circuits located in the same one of the plurality of pixel rows is one, and the number of the plurality of second gate strobe circuits of the same stage electrically connected to the plurality of the pixel driving circuits located in the same one of the plurality of pixel rows is one; and wherein the plurality of first strobe driving circuits and the plurality of second strobe driving circuits are disposed alternately in the first non-display region and the second non-display region, and the plurality of first strobe driving circuits and the plurality of second strobe driving circuits are all located on a side of the plurality of third strobe driving circuits close to the display region.

8. The display panel as claimed in claim 1, wherein in the writing frame and the holding frame, a sum of a number of the valid pulses of the first start signal is greater than a sum of a number of the valid pulses of the second start signal.

9. The display panel as claimed in claim 8, wherein in the writing frame, a first one of the valid pulses of the first start signal at least partially overlaps with the valid pulses of the second start signal.

10. The display panel as claimed in claim 1, wherein an active layer of the third transistor and an active layer of the fourth transistor both include low-temperature polycrystalline-silicon.

11. A display device, comprising:

a display comprising a plurality of strobe driving circuits and a plurality of pixel rows, wherein a plurality of strobe driving circuits comprising a plurality of cascaded first strobe driving circuits, a plurality of cascaded second strobe driving circuits, and a plurality of cascaded third strobe driving circuits, the plurality of cascaded first strobe driving circuits respond to a first start signal to output a plurality of first strobe signals, the plurality of cascaded second strobe driving circuits respond to a second start signal to output a plurality of second strobe signals, the plurality of cascaded third strobe driving circuits respond to a third start signal to output a plurality of third strobe signals; in a writing frame and a holding frame, valid pulses of the first start signal and valid pulses of the second start signal are in action time of invalid pulses of the third start signal; and wherein each of the plurality of pixel rows comprises a plurality of sub-pixels and a plurality of pixel driving circuits electrically connected to the plurality of sub-pixels, each of the pixel driving circuits comprises a first transistor, a second transistor, a third transistor, a fourth transistor, a fifth transistor, a sixth transistor, and a seventh transistor; the second transistor responds to corresponding one of the plurality of first strobe signals to transmit a data signal so that the first transistor generates a driving current of controlling the plurality of sub-pixels to emit light according to the data signal, the third transistor responds to corresponding one of the plurality of second strobe signals to compensate a threshold value of the first transistor, the fourth transistor responds to corresponding one of the plurality of second strobe signals to transmit a first reset signal to a gate electrode of the first transistor, the fifth transistor and the sixth transistor simultaneously respond to same corresponding one of the plurality of third strobe signals so that the first transistor provides the driving current to the plurality of sub-pixels, the seventh transistor responds to corresponding one of the plurality of first strobe signals to transmit a second reset signal to an anode of the plurality of sub-pixels; and a time schedule controller, wherein the time schedule controller is electrically connected to the plurality of strobe driving circuits; and wherein stages of the plurality of first strobe signals responded by the second transistor and the seventh transistor are different, stages of the plurality of second strobe signals responded by the third transistor and the fourth transistor are different, each of the plurality of third strobe driving circuits is electrically connected to the plurality of the pixel driving circuits in adjacent two of the plurality of pixel rows; a number of the plurality of first gate strobe circuits of a same stage electrically connected to the plurality of the pixel driving circuits located in a same one of the plurality of pixel rows is at most two, a number of the plurality of second gate strobe circuits of a same stage electrically connected to the plurality of the pixel driving circuits located in the same one of the plurality of pixel rows is at most two, and a number of the plurality of third gate strobe circuits of a same stage electrically connected to the plurality of the pixel driving circuits located in the same one of the plurality of pixel rows is at most two.

12. The display device as claimed in claim 11, wherein the display panel comprises:

a display region, wherein the plurality of pixel rows are located in the display region; and a non-display region located on periphery of the display region, wherein the plurality of strobe driving circuits are located in the non-display region, the non-display region comprises a first non-display region and a second non-display region located on two opposite sides of the display region; and wherein there is a first row number of the plurality of strobe driving circuits located in the first non-display region, there is a second row number of the plurality of strobe driving circuits located in the second non-display region, and the first row number is equal to the second row number.

13. The display device as claimed in claim 12, wherein a circuit structure of the plurality of second strobe driving circuits is same as a circuit structure of the plurality of first strobe driving circuits, two of the plurality of first strobe driving circuits of a same stage electrically connected to the plurality of pixel driving circuits of a same one of the plurality of pixel rows are respectively located in the first non-display region and the second non-display region, two of the plurality of second strobe driving circuits of a same stage electrically connected to the plurality of pixel driving circuits of a same one of the plurality of pixel rows are respectively located in the first non-display region and the second non-display region, and two of the plurality of third strobe driving circuits of a same stage electrically connected to the plurality of pixel driving circuits of a same one of the plurality of pixel rows are respectively located in the first non-display region and the second non-display region; and wherein in the first non-display region and the second non-display region, the plurality of second strobe driving circuits are located between the plurality of first strobe driving circuits and the plurality of third strobe driving circuits, and the plurality of third strobe driving circuits are located on a side of the plurality of second strobe driving circuits away from the display region.

14. The display device as claimed in claim 12, wherein a circuit structure of the plurality of second strobe driving circuits is same as a circuit structure of the plurality of third strobe driving circuits, two of the plurality of first strobe driving circuits of a same stage electrically connected to the plurality of pixel driving circuits of a same one of the plurality of pixel rows are respectively located in the first non-display region and the second non-display region; and one of the plurality of second strobe driving circuits electrically connected to the third transistor of the plurality of pixel driving circuits located in a same one of the plurality of pixel rows, and one of the plurality of second strobe driving circuits electrically connected to the fourth transistor of the plurality of pixel driving circuits located in a same one of the plurality of pixel rows are respectively located in the first non-display region and the second non-display region; and two of the plurality of third strobe driving circuits of a same stage electrically connected to the plurality of pixel driving circuits of a same one of the plurality of pixel rows are respectively located in the first non-display region and the second non-display region; and wherein in the first non-display region and the second non-display region, the plurality of second strobe driving circuits are located between the plurality of first strobe driving circuits and the plurality of third strobe driving circuits, and the plurality of third strobe driving circuits are located on a side of the plurality of second strobe driving circuits away from the display region.

15. The display device as claimed in claim 12, wherein two of the plurality of first strobe driving circuits of a same stage electrically connected to the plurality of pixel driving circuits of a same one of the plurality of pixel rows are respectively located in the first non-display region and the second non-display region, the number of the plurality of second gate strobe circuits of the same stage electrically connected to the plurality of the pixel driving circuits located in the same one of the plurality of pixel rows is one, and the number of the plurality of third gate strobe circuits of the same stage electrically connected to the plurality of the pixel driving circuits located in the same one of the plurality of pixel rows is one; and wherein the plurality of the second strobe driving circuits are all located in the second non-display region, the plurality of third strobe driving circuits are all located in the first non-display region, and the plurality of second strobe driving circuits and the plurality of third strobe driving circuits are all located on a side of the plurality of first strobe driving circuits away from the display region.

16. The display device as claimed in claim 12, wherein two of the plurality of second strobe driving circuits of the same stage electrically connected to the plurality of pixel driving circuits of the same one of the plurality of pixel rows are respectively located in the first non-display region and the second non-display region, and the number of the plurality of first gate strobe circuits of the same stage electrically connected to the plurality of the pixel driving circuits located in the same one of the plurality of pixel rows is one, and the number of the plurality of third gate strobe circuits of the same stage electrically connected to the plurality of the pixel driving circuits located in the same one of the plurality of pixel rows is one; and wherein the plurality of the first strobe driving circuits are all located in the second non-display region, the plurality of third strobe driving circuits are all located in the first non-display region, and the plurality of first strobe driving circuits and the plurality of third strobe driving circuits are all located on a side of the plurality of second strobe driving circuits away from the display region.

17. The display device as claimed in claim 12, wherein two of the plurality of third strobe driving circuits of a same stage electrically connected to the plurality of pixel driving circuits of a same one of the plurality of pixel rows are respectively located in the first non-display region and the second non-display region; and the number of the plurality of first gate strobe circuits of the same stage electrically connected to the plurality of the pixel driving circuits located in the same one of the plurality of pixel rows is one, and the number of the plurality of second gate strobe circuits of the same stage electrically connected to the plurality of the pixel driving circuits located in the same one of the plurality of pixel rows is one; and wherein the plurality of first strobe driving circuits and the plurality of second strobe driving circuits are disposed alternately in the first non-display region and the second non-display region, and the plurality of first strobe driving circuits and the plurality of second strobe driving circuits are all located on a side of the plurality of third strobe driving circuits close to the display region.

18. The display device as claimed in claim 11, wherein in the writing frame and the holding frame, a sum of a number of the valid pulses of the first start signal is greater than a sum of a number of the valid pulses of the second start signal.

19. The display device as claimed in claim 18, wherein in the writing frame, a first one of the valid pulses of the first start signal at least partially overlaps with the valid pulses of the second start signal.

20. The display device as claimed in claim 11, wherein an active layer of the third transistor and an active layer of the fourth transistor both include low-temperature polycrystalline-silicon.

* * * * *